United States Patent [19]

Saarem

[11] 4,097,763

[45] Jun. 27, 1978

[54] ELECTRIC PROGRAMMER

[75] Inventor: Myrl J. Saarem, Carson City, Nev.

[73] Assignee: Richdel, Inc., Carson City, Nev.

[21] Appl. No.: 765,882

[22] Filed: Feb. 7, 1977

[51] Int. Cl.[2] ..... H01H 7/00

[52] U.S. Cl. ..... 307/141; 200/38 R

[58] Field of Search ..... 307/141, 141.4, 141.8; 200/38 DA, 38 R

[56] References Cited

U.S. PATENT DOCUMENTS

| | | | |
|---|---|---|---|
| Re. 25,805 | 6/1965 | Gould | 307/141 |
| 2,988,932 | 6/1961 | Swanson | 200/38 R |

*Primary Examiner*—Robert K. Schaefer
*Assistant Examiner*—Morris Ginsburg
*Attorney, Agent, or Firm*—Keith D. Beecher

[57] ABSTRACT

An electric programmer is provided which has general utility, although it will be described herein for controlling electrically-operated water valves in a lawn sprinkler system. The programmer is constructed to control a plurality of different valves for successive time intervals at one or more predetermined time period during each day of the week, although means are provided to enable the programmer to skip one or more days, if so desired. The programmer to be described includes means which permits a separate setting to be manually established for each of the valves which determines the length of the time interval each valve is to be activated during the aforesaid time period.

3 Claims, 10 Drawing Figures

ELECTRIC PROGRAMMER

BACKGROUND OF THE INVENTION

U.S. Pat. No. Re. 25,805, which is assigned to the present assignee, describes and claims an electric programmer of the same general type as the programmer of the present invention. The programmer of the present invention, like the programmer described in the patent, is comparatively simple in its construction, and it is capable of being used in certain non-critical type applications where extreme accuracy of a programming operation is not required.

The programmer of the present invention is easy and convenient to use. An important feature of the programmer is the provision of manual controls which are directly accessible from the front of the programmer. These controls are adjustable to set the time interval that each of the valves or other instrumentalities, activated by the programmer of the invention, is to remain in its active state.

DETAILED DESCRIPTION OF THE ILLUSTRATED EMBODIMENT

Figure 1:
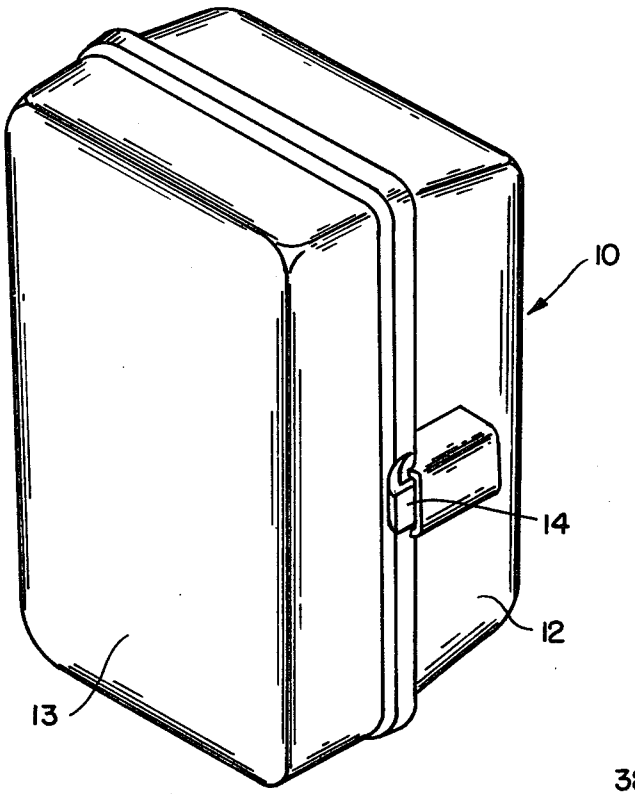
FIG. 1 is a perspective view of the programmer of the invention with the cover in place.

The programmer of the invention is designated 10 in FIG. 1, and it includes a housing 12, and a cover 13 hinged to the housing. The cover is held in a closed condition with respect to the housing by an appropriate latch 14.

Figure 2:
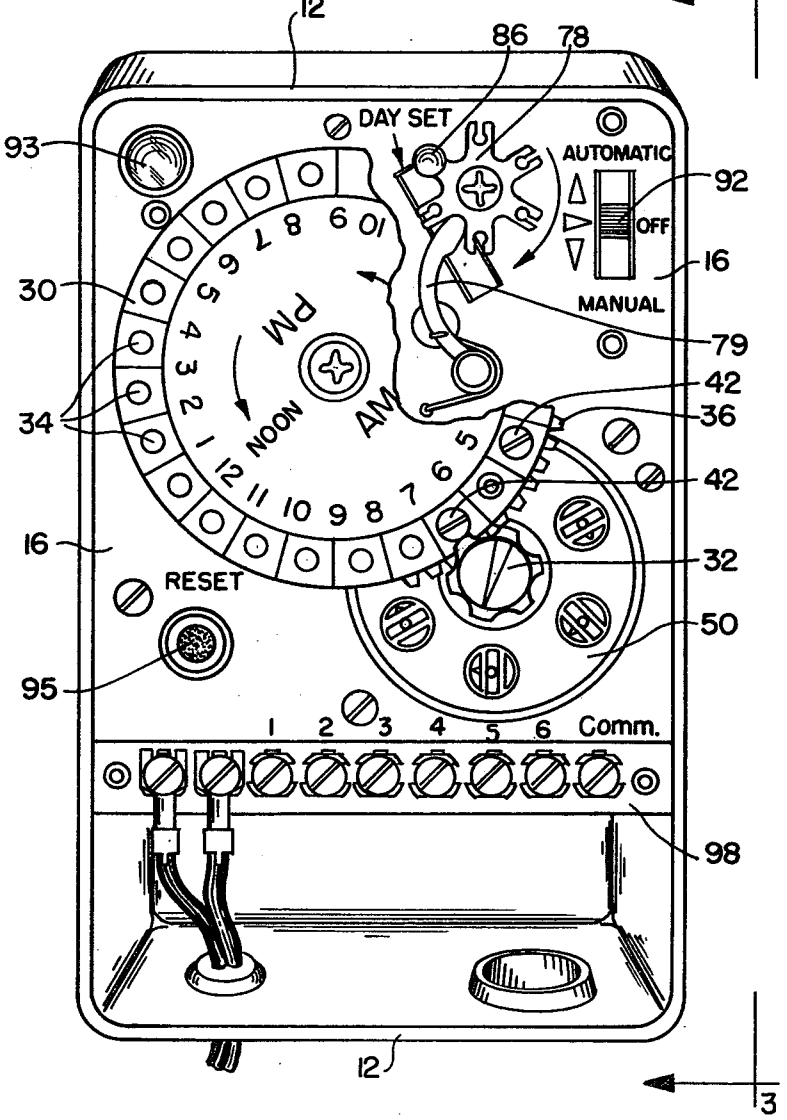
FIG. 2 is a front elevational view of the programmer of FIG. 1, with the cover removed to reveal the internal operating components of the programmer.

As shown in FIG. 2, a mounting plate 16 is supported within the housing 12 which, in turn, supports a conventional type of clock motor 18 (FIG. 3), from which projects a shaft 20 on which is mounted a small gear 22. Gear 22 drives a second larger gear 24 which is mounted on shaft 26, the shaft 26 being supported by the mounting plate 16. During operation of the mechanism, the clock motor 18 drives a clutch and dial assembly (to be described) around shaft 26, through its drive shaft 20, and through gears 22 and 24.

A conventional clutch 28 is rotatably mounted on shaft 26. The clutch carries a disc 30 in such a manner that the disc 30 is normally rotated by the motor 18 in a counterclockwise direction as it is viewed in FIG. 2. The clutch 28 permits disc 30 to be rotated by hand in a counterclockwise direction, as viewed in FIG. 2, so as to permit the disc to be set to any desired time position when the programmer 10 is being installed or adjusted.

Figure 4:
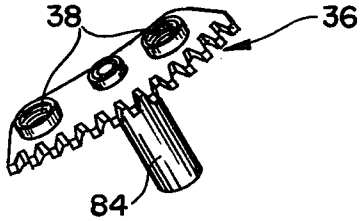
FIG. 4 is a perspective view of a part employed in the programmer of FIGS. 1 through 3.

From an examination of FIG. 2, it will be seen that disc 30 carries a plurality of indicia corresponding to the conventional hour markings on a 24-hour clock, and that a small pointer 32 is printed upon a circuit selector control (to be described) so as to facilitate the setting of the disc 30 to any desired angular position with respect to the hour markings on its face. The disc 30 is provided with a plurality of equi-spaced holes 34 located around its periphery. These holes 34 correspond in spacing to various desired time periods with respect to the hour markings on the disc 30. The holes 34 are designed so that a segmental gear 36, as illustrated in FIG. 4 of the drawings, may be mounted on the disc 30 at any desired location around its periphery.

The segmental gear 36 includes annular projections 38 which are adapted to be located on the under surface of disc 30 and to fit within the corresponding holes 34. The annular projections are internally threaded to receive screws 42 (FIG. 2) which serve to mount the segmental gear 36 on the disc 30 at the desired angular position, in order to hold the segmental gear 36 securely on disc 30, so that it is rotated with disc 30. The segmental gear 36 may be made any length desired so as to correspond to a given time period. Furthermore, if desired, several additional segmental gears (not shown) corresponding to the segmental gear 36 may be mounted upon the disc 30 at other angular positions.

Figure 3:
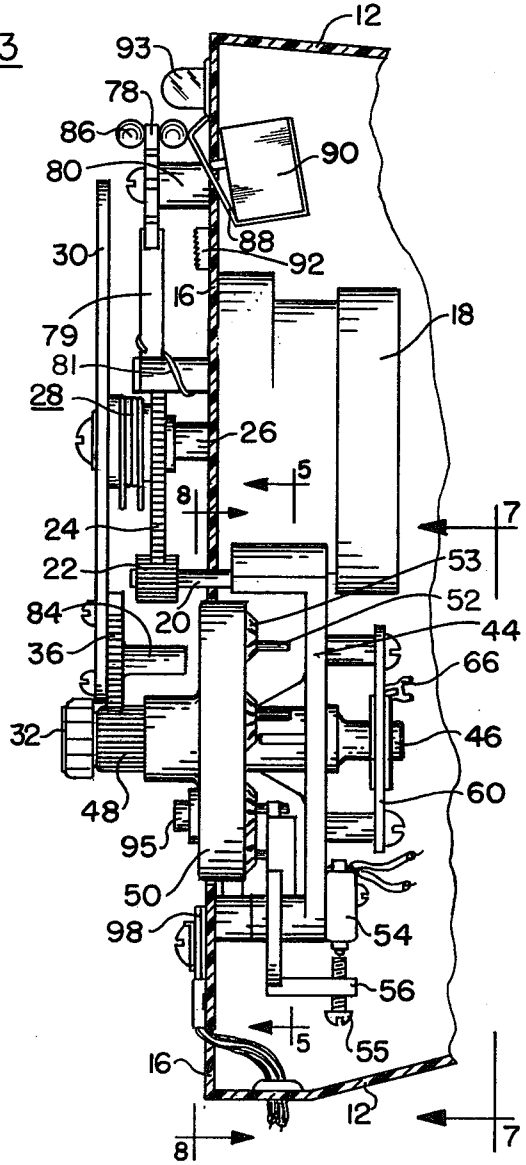
FIG. 3 is a side view of the programmer of FIG. 2, taken essentially along the line 3—3 of FIG. 2.

A framework 44 is attached to the rear side of plate 16 adjacent to the motor 18 (FIG. 3). This framework 44 rotatably supports a programmer shaft 46, on which is mounted gear 48. Gear 48 is adapted to be engaged by the segmental gear 36 during rotation of the disc 30 so as to cause rotation of the shaft 46. Preferably the segmental gear 36 is proportioned as to dimensions with respect to gear 48 so that gear 48 is turned one complete revolution each time it is engaged by the segmental gear 36.

Figure 6:
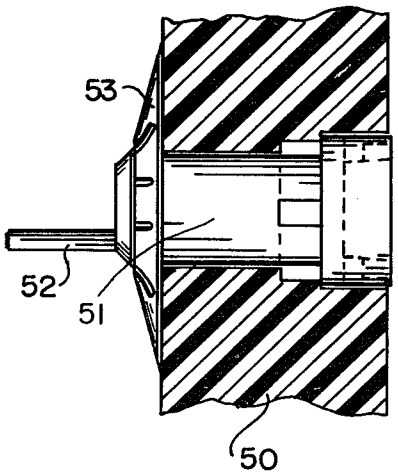
FIG. 6 is a partial section taken along the line 6—6 of FIG. 5.
Figure 5:
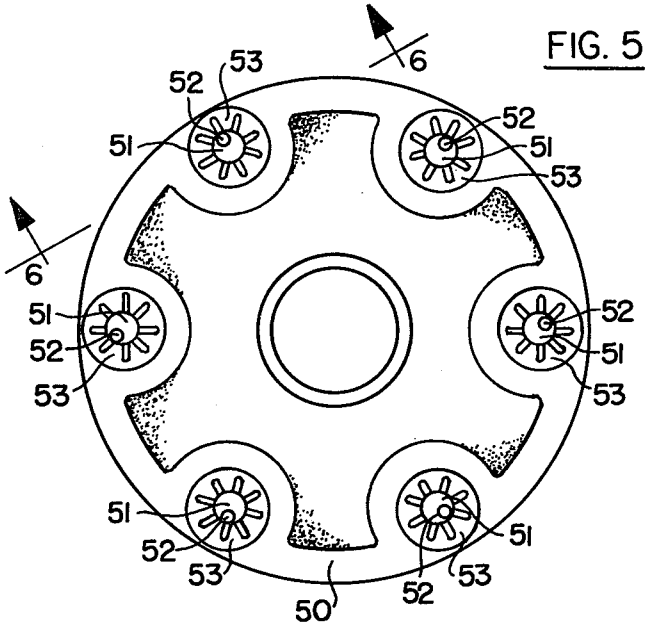
FIG. 5 is a sectional view taken along the line 5—5 of FIG. 3.
Figure 10:
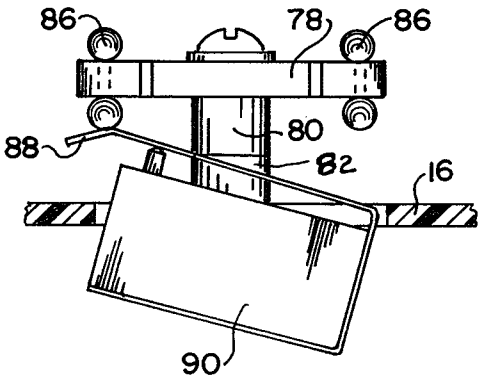
FIG. 10 is a fragmentary perspective representation of certain details of the programmer.
Figure 8:
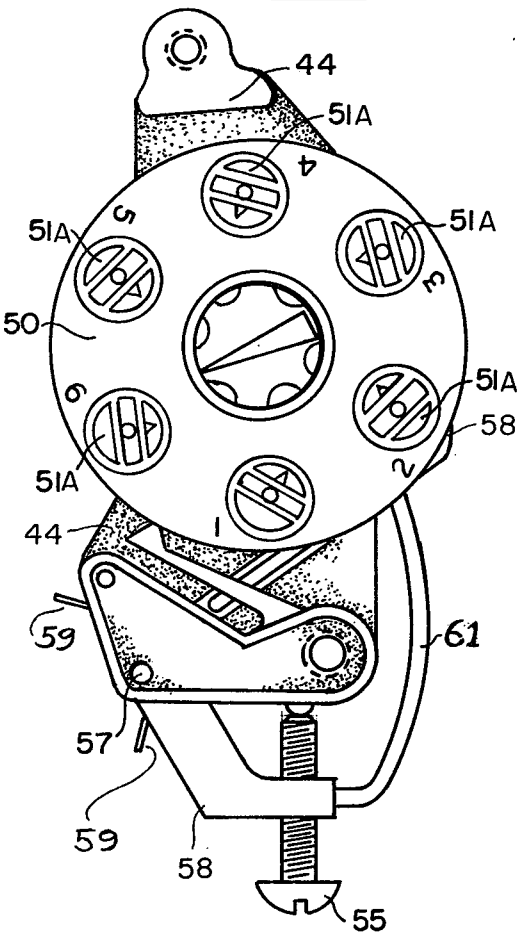
FIG. 8 is a sectional view taken along the line 8—8 of FIG. 3.

The shaft 46 carries disc 50 which, in turn, carries a plurality of individual shafts 51. Each shaft 51 (FIG. 6) is rotatably mounted on disc 50, and each carries an eccentric pin 52 at its inner extremity, as shown in FIGS. 5 and 6. Each shaft 51 is held within disc 50 by a serrated retaining ring 53. Each of the shafts 51 is supported in the disc 50 by a detent arrangement, and each has a head 51A (FIG. 8) which may be turned by a screwdriver to any desired angular position, so as to set its eccentric pin 52 at a corresponding angular position.

Figure 7:
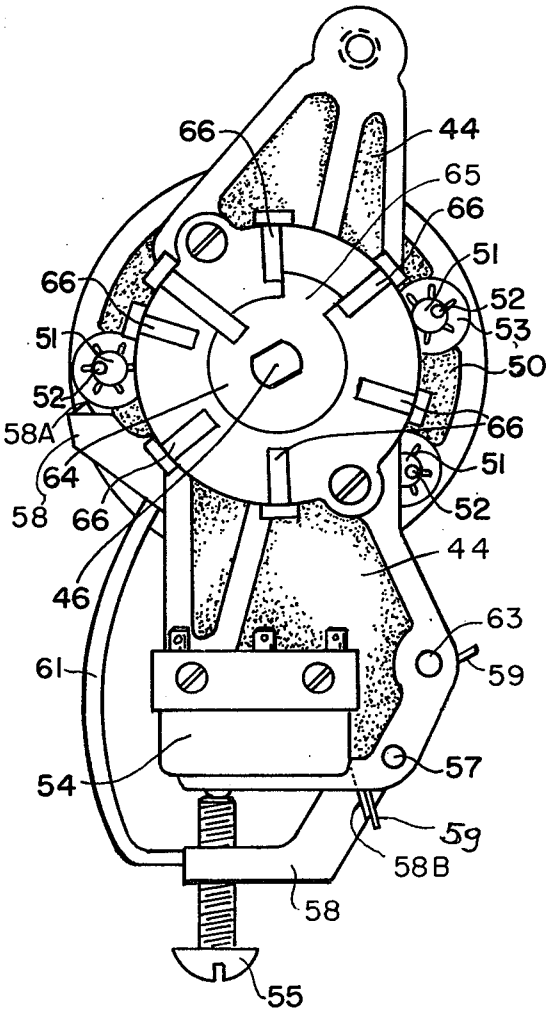
FIG. 7 is a sectional view taken along the line 7—7 of FIG. 3.

The framework 44 also carries a small snap-action switch 54 of conventional design capable of making and breaking a conventional alternating or direct current circuit (FIG. 7). The switch 54 is operated by a screw 55 which is threaded into one end of an angular switch actuator arm 58. Arm 58 is rotatably supported on the frame 44 by a pivot pin 57, and the arm is spring-biased in a clockwise direction in FIG. 7 by an appropriate coil spring 59 (FIG. 8) which is coiled around pivot pin 57. One end of the coil spring 59 engages a shoulder 58B on actuator arm 58, and the other end of the coil spring engages a post 63. The actuator arm 58 is integral with an annular member 61.

The actuator 58 is positioned so that in the "off" position of switch 54 its other end rests between two of the eccentric pins 52. However, as the shaft 46 is turned by the segmental gear 36, the pins 52 will engage a projection 58A on the actuator 58 and will cause the actuator to turn against the bias of spring 59, in a counterclockwise direction in FIG. 7. As the shaft 46 continues to turn, the actuator arm 58 moves screw 55 away from the switch 54 so that at a given predetermined point the switch 54 closes. By turning the individual eccentric shafts 51 (FIG. 6) it is possible to vary the duration of the time interval when the switch 54 is on or off, for each actuation of the switch by the different eccentric pins 52, as the disc 50 is turned by the arcuate segmental gear 36.

As shown in FIG. 2, the individual shafts 51 are easily accessible from the front of the instrument, and each may be set to a desired angular setting by a simple screwdriver adjustment. The portion of the front face of disc 50 adjacent each of the shafts 51 may be suitably calibrated, so that the shafts may be set to establish individual activation times of the circuits controlled thereby for intervals, for example, extending from five to thirty minutes, for each valve.

The shaft 46 also carries a rotatable switch wafer 60 which serves as a distribution switch. The wafer 60 supports a rotatable wiper contact disc 64 which is turned by the shaft 46, and which is formed of appropriate metal. The wiper contact disc 64 serves to complete an electric circuit between a common switch contact 65 and a plurality of further contacts 66, on a selective basis as the disc 64 is rotated.

The programmer 10 also includes a star wheel 78 (FIG. 2) which is mounted on a shaft 80 which is rotatably secured by a bearing 82 to the plate 16. Star wheel 78 is engaged by a spring-loaded pawl arm 79, so that the star wheel may be detented from one angular position to the next. The star wheel 78 is adapted to be rotated a fraction of a turn one each time disc 30 is rotated by engagement with a pin 84 secured to the underside of segmental gear 36 (FIGS. 3 and 4). As disc 30 turns in a counter-clockwise direction, pin 84 is moved down against pawl 79 in FIG. 3 causing the pawl to turn down into the plane of the drawing against the tension of its spring 81, so as to turn the star wheel 78 from one angular position to the next. Pin 84 then slides over the end of the pawl and the pawl springs back to its original position. The star wheel 78 may carry one or more dependent pins 86 which are adapted to engage an actuating arm 88 of a switch 90 of a conventional design, the switch being mounted on plate 16. The plate 16 also mounts a switch 92 which is used in controlling the operation of the programmer.

The switch 92 may be switched to a central "off" position in which the operating circuits of the programmer are de-activated, although the clock motor 18 continues to turn the disc 30. This setting of the switch 92 is appropriate, for example, for a rainy day. The switch 92 may be set to "automatic" for normal operation of the programmer. The switch may also be set to "manual" which permits the circuit selector disc 50 to be turned manually to activate any one of the circuits, merely by manually turning gear 48, when it is not engaged by the segmental gear 36.

Figure 9:
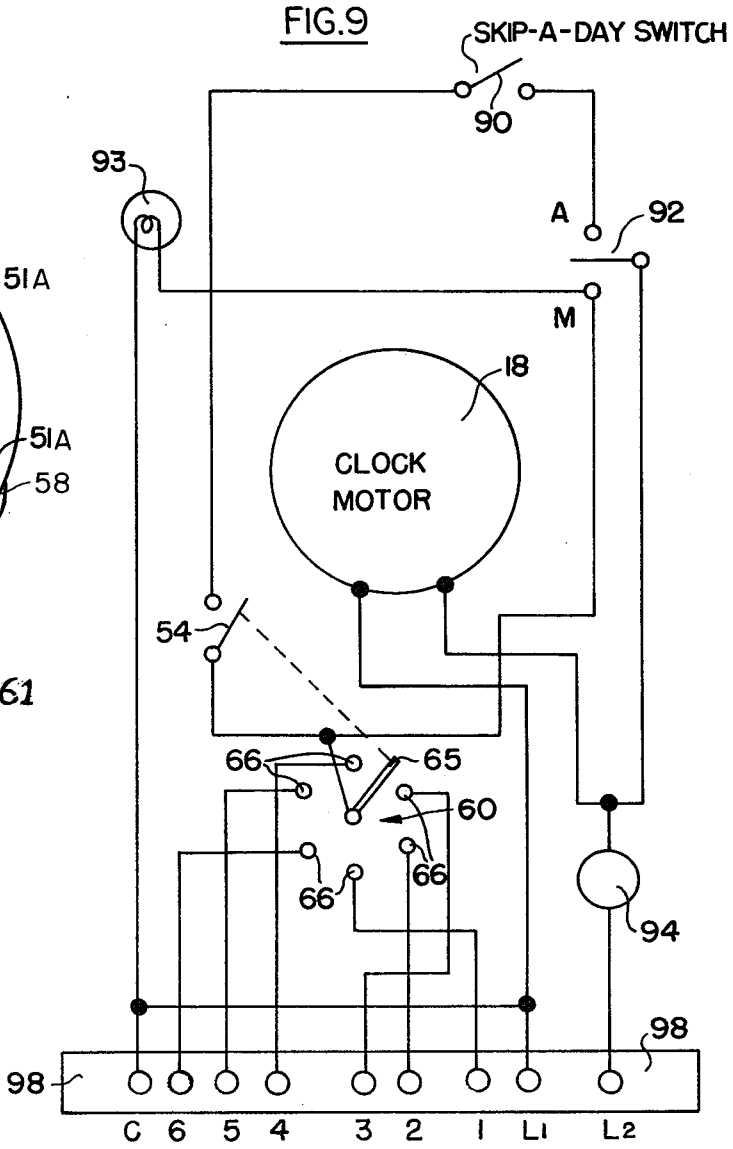
FIG. 9 is a schematic wiring diagram showing the electrical connections within the programmer.

As shown by the wiring diagram of FIG. 9, the programmer includes a terminal board 98. The circuit is supplied, for example, with 24-volts, 60 cycle alternating current by line connections to the two terminals designated L1 and L2. These terminals are connected to the clock motor 18 through a circuit breaker 94 which may be reset by a reset button 95 (FIG. 2). The terminal L2 is also connected to the common contact of the switch 92. The manual contact of switch 92 is connected to the movable contact 65 of the wafer switch 60 and through a pilot light 93 to the terminal L1. The contacts 66 of switch 60 are connected to respective terminals 1–6 on the terminal strip 98. The terminal L1 is also connected to a common terminal C. The various electric operated valves of the sprinkler system in which the programmer is incorporated are connected between the common terminal C and respective ones of the terminals 1–6.

It will be appreciated that when switch 92 is set to "manual" (M), the pilot light 93 will be energized, and the movable contact 65 of wafer switch 60 may be moved manually to any one of the contacts 66 of the wafer switch to complete a circuit to the electric valve connected to a corresponding one of the terminals 1–6. The particular valve will then remain energized until the movable contact 65 is moved off the corresponding switch contacts 66.

For automatic operation, the switch 92 is set to "automatic" (A). Then, whenever the segmental gear 36 on disc 30 engages the circuit selector, the movable contact 65 is moved successively from one contact 66 to another, so that the various electric valves connected to terminals 1–6 may be successively activated. In each instance, the valves remain activated for as long as switch 54 is closed, and this interval for each electrically operated valve, is controlled by rotating the respective shafts 51. However, the corresponding electrically operated valves are energized only if the skip-a-day switch 90 is closed by a projection 86 on the star wheel 78. Therefore, on any day in which it is desired that the valves are not to be energized, the projection 86 is removed from the star wheel for that particular day.

It wll be appreciated, of course, that although a particular embodiment of the invention has been shown and described, modifications may be made. It is intended in the claims to cover the modifications which come within the true spirit and scope of the invention.

What is claimed is:

1. In an electric programmer, which includes: mounting means; clock motor means supported by said mounting means; a control disc rotatably mounted on said mounting means and connected to said clock motor means to be rotated thereby; gear actuating means attached to said control disc; a first shaft rotatably mounted on said mounting means; a gear coaxially mounted on said first shaft to be engaged by said gear actuating means during rotation of said control disc to turn said first shaft; a rotary distribution switch mounted on said mounting means and including a wiper contact connected to the first shaft to be rotated thereby, and further including a plurality of switch contacts to be selectively contacted as the wiper contact is rotated; switching means mounted on said mounting means and including an actuating arm; and switch actuating means for operating said switching means for manually controllable time intervals as said first shaft rotates and as said wiper contact engages successive ones of said switch contacts, said switch actuating means including: a selector disc coaxially mounted on said first shaft to be rotated thereby; a plurality of further shafts rotatably mounted in said selector disc and extending parallel to the first shaft; and a corresponding plurality of longitudinally-extending pins eccentrically mounted at the extremities of the respective further shafts in positions successively to engage said actuating arm as said first shaft rotates, the time interval of engagement of any one of said pins with said actuating arm being determined by the angular position of such pin with respect to the longitudinal axis of the corresponding further shaft.

2. The combination defined in claim 1, in which said mounting means includes a mounting plate, and in which said selector disc is positioned in an opening in the mounting plate to be accessible therethrough.

3. The combination defined in claim 1, in which each of said further shafts is rotatably mounted in said selector disc in engagement with detent means to permit each of said further shafts to be turned to predetermined angular positions with respect to the longitudinal axis thereof.

* * * * *